US011678724B2

(12) United States Patent
Lopez et al.

(10) Patent No.: US 11,678,724 B2
(45) Date of Patent: Jun. 20, 2023

(54) CUSTOMIZABLE LASTS

(71) Applicant: HEWLETT-PACKARD DEVELOPMENT COMPANY, L.P., Houston, TX (US)

(72) Inventors: Matthew G. Lopez, San Diego, CA (US); Michael T. Credelle, San Diego, CA (US); David Dav Hoag, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 992 days.

(21) Appl. No.: 16/077,697

(22) PCT Filed: Jun. 14, 2017

(86) PCT No.: PCT/US2017/037501
§ 371 (c)(1),
(2) Date: Aug. 13, 2018

(87) PCT Pub. No.: WO2018/231223
PCT Pub. Date: Dec. 20, 2018

(65) Prior Publication Data

US 2021/0177101 A1 Jun. 17, 2021

(51) Int. Cl.
*A43D 3/02* (2006.01)

(52) U.S. Cl.
CPC ..... *A43D 3/027* (2013.01)

(58) Field of Classification Search
CPC ..... A43D 3/00; A43D 3/025; A43D 3/14
USPC ..... 12/133 A, 133 B
See application file for complete search history.

(56) References Cited

U.S. PATENT DOCUMENTS 1,565,057 A * 12/1925 Chappell ..... A43D 3/027 12/124
1,757,594 A * 5/1930 Shaw ..... A43D 3/028 12/140
3,241,166 A * 3/1966 Jonas ..... A43D 3/027 12/133 B
3,335,428 A * 8/1967 Gajdos ..... A61F 2/66 623/55
3,698,105 A * 10/1972 Rubico ..... A43D 3/02 36/83
3,724,014 A * 4/1973 Bennett ..... A43D 3/027 12/146 L (Continued)

FOREIGN PATENT DOCUMENTS

CN 1692853 11/2005
CN 202750844 U 2/2013

(Continued)

OTHER PUBLICATIONS

Chen et al., "Dynamic Numerical Analysis of the "Foot—Training Shoe" Model", Procedia Manufacturing, vol. 3, Retrieved from Internet—https://www.sciencedirect.com/science/article/pii/S2351978915007131, 2015, pp. 5519-5526.

*Primary Examiner* — Jocelyn Bravo
(74) *Attorney, Agent, or Firm* — Michael Dryja

(57) ABSTRACT

An example customizable shoe last includes a solid portion and an adjustable portion. The adjustable portion includes a moldable material that is selectively solidifiable for footwear manufacture. The customizable shoe last also includes an interchangeable mold cover to enclose the adjustable portion.

19 Claims, 5 Drawing Sheets

(56) References Cited

U.S. PATENT DOCUMENTS

| | | | | |
|---|---|---|---|---|
| 3,790,978 | A * | 2/1974 | Condamine | F16M 11/28 12/146 L |
| 4,716,662 | A * | 1/1988 | Bar | A43B 7/28 12/146 B |
| 5,881,413 | A * | 3/1999 | Throneburg | A43D 3/023 12/133 B |
| 7,980,007 | B2 | 7/2011 | Cook et al. | |
| 11,155,944 | B2 * | 10/2021 | Adami | B29C 51/02 |
| 2004/0226115 | A1 * | 11/2004 | Gunnsteinsson | A43D 1/022 12/146 L |
| 2011/0030154 | A1 * | 2/2011 | Yoon | A43D 3/00 12/133 R |
| 2012/0304492 | A1 * | 12/2012 | Leung | A43D 3/02 36/83 |
| 2014/0259461 | A1 * | 9/2014 | Scofield | B29D 35/126 12/145 |
| 2016/0100650 | A1 * | 4/2016 | Davis | A43B 5/16 36/91 |
| 2016/0135546 | A1 | 5/2016 | Langvin et al. | |
| 2016/0206049 | A1 * | 7/2016 | Kallayil | A43D 3/04 |
| 2020/0297078 | A1 * | 9/2020 | Lopez | G06Q 50/04 |

FOREIGN PATENT DOCUMENTS

| | | | |
|---|---|---|---|
| CN | 204617235 | U | 9/2015 |
| CN | 204763695 | | 11/2015 |
| GB | 650623 | | 2/1951 |
| RU | 55548 | U1 | 8/2006 |
| SU | 795530 | A1 | 1/1981 |
| WO | WO-2004071229 | | 8/2004 |

* cited by examiner

CUSTOMIZABLE LASTS

BACKGROUND

Footwear, such as shoes, may comprise a number of components. For instance, a shoe may have a sole made, for example, of leather or rubber upon which may be arranged an upper, at times made of a leather or synthetic material. Footwear components may be assembled on a mold having a shape corresponding to a foot, referred to as a last.

BRIEF DESCRIPTION OF THE DRAWINGS

Various examples will be described below by referring to the following figures.

Figure 1:
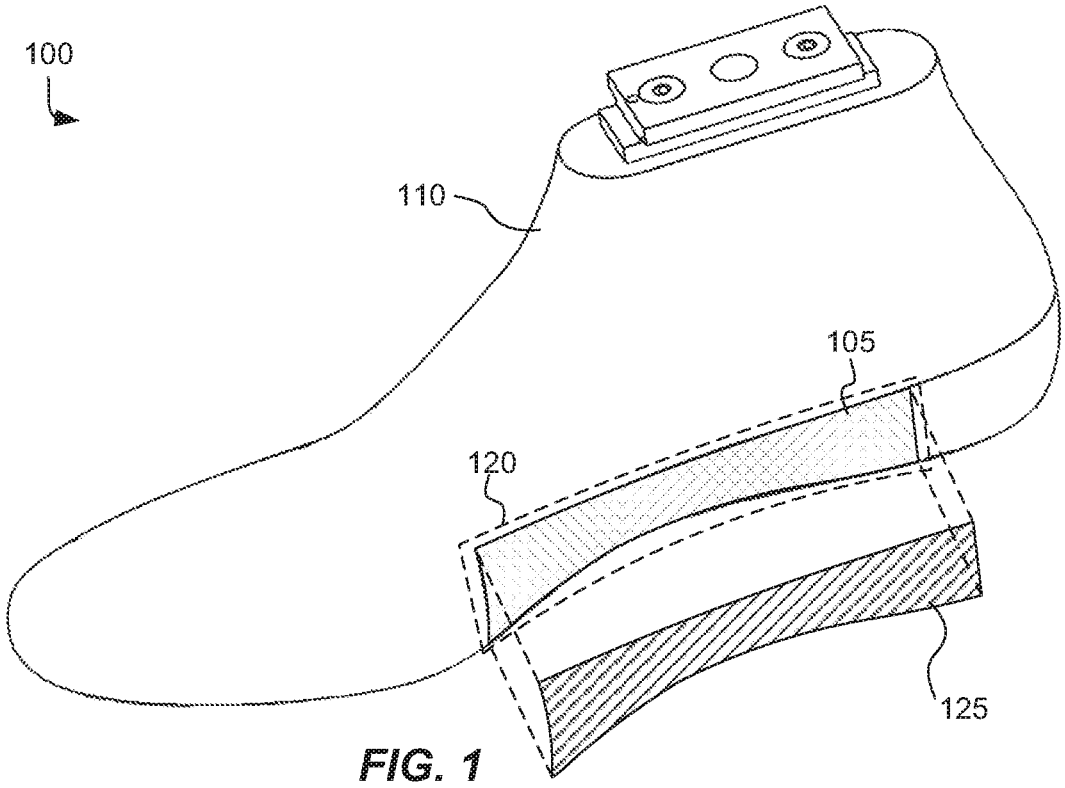
FIG. 1 is profile view of an example customizable last.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration.

DETAILED DESCRIPTION

At times, footwear is manufactured using lasts, which are forms having a shape corresponding to that of a foot, and upon which components of the footwear are assembled. Lasts may have different shapes and dimensions based on the shapes and dimensions desired for footwear. For example, different lasts may be used for footwear for right and left feet, respectively; different lasts may be used for footwear for different foot sizes; different lasts may be used for footwear for feet of different width; different lasts may be used for footwear to have different arch geometry; etc. Because lasts are typically made using blocks of solid materials, such as woods, plastics, and metals, a large number of lasts may be used in footwear fabrication processes based on different footwear sizes and shapes. This can add to complexity of footwear fabrication (e.g., using a correctly-sized and shaped last) and last storage (e.g., having to store a number of lasts), among other things.

A number of alternatives to solid lasts have been proposed. By way of example, lasts made of a selectively solidifiable material that may be selectively molded to a desired shape and size (hereinafter referred to alternatively as geometry) within a solid mold have been used. However, such an alternative would still use a number of solid molds for different foot geometries. Another alternative includes spreadable lasts in which portions of a last may be selectively moved to achieve different last geometries. For instance, a narrow last may be spread apart to act as a wide last, etc. Spreadable lasts may not be desirable for certain footwear manufacturing, however, such as cases in which materials are injected around the last, at least because the injected materials may enter gaps within the spreadable last.

There may be a desire, therefore, for lasts that may be customizable without the complexity of having a number of different components and/or molds, and that may be usable for shoe manufacture processes that use injection molding, by way of example.

In one case, a customizable last may have a solid portion and an adjustable portion. The adjustable portion may comprise a hollow receptacle to receive a moldable material that may be selectively solidified. An interchangeable mold cover may be arranged to enclose the moldable material, and the moldable material may be caused to take a form corresponding to that of the interchangeable mold cover. The moldable material is to solidify for footwear manufacture, and to return to a moldable state (e.g., liquid, malleable, etc.) for adjustment of the adjustable portion. A component of the customizable last may allow application of backpressure to the moldable material in order to enable forming the moldable material to the interchangeable mold cover. For instance, backpressure may be applied to the moldable material to cause the moldable material to press against the interchangeable mold cover. In one case, the adjustable portion may be arranged in a detachable lower portion of the customizable last to enable solidification of the moldable material separately from an upper portion of the customizable last. For example, an adjustable portion may correspond to an arch and/or heel of a last, and a moldable material may enable customization of an arch and/or heel portion of a last.

It may be that use of a moldable material and an interchangeable mold cover may be desirable, such as to reduce complexity of last customization, such as by reducing a number of lasts and last attachments to be used in footwear manufacture. For instance, interchangeable mold covers may have a relatively small profile and may be stored in comparatively little space. Further, the moldable material may be used and reused for a number of different foot geometries. Additionally, the use of an adjustable portion may be desirable for footwear manufacture that uses injection molding, such as because injection molding may be performed without injected material entering gaps within a last.

Figure 8:
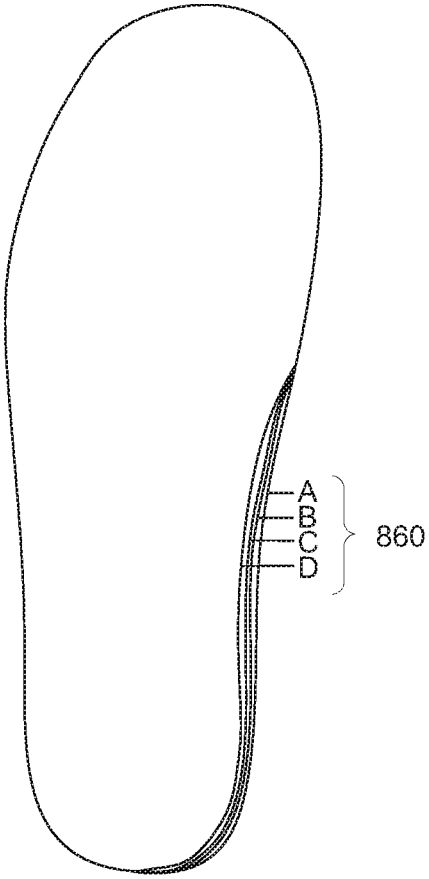
FIG. 8 illustrates different example arch and heel geometries.

As noted above, there may be a desire for lasts that may be used to manufacture footwear that may be customized for a particular size and shape of a foot. FIG. 1 shows a sample last 100 with an adjustable portion 120, indicated with a broken line to bring attention to a particular portion of last 100 that may be adjustable. Thus, for example, a particular size (width and height) of adjustable portion 120 may be capable of changing. Furthermore, a particular shape of adjustable portion 120 may be capable of being adjusted. To illustrate, a shape of an arch may vary among feet of different people and even among left and right feet of a particular person. Reference is made to FIG. 8, which illustrates an outline of a sample foot and illustrating different arch and heel shapes and sizes, A-D (collectively, element 860). As should be appreciated, there may be a desire to provide a shoe with additional arch and heel support for feet having a shape corresponding to an arch and heel shape indicated by D. Conversely, less support may be needed for a foot having an arch and heel shape such as that indicated by A. Arch and heel shapes indicated by B and C indicate further additional examples and suggest a desire for an ability to customize lasts for particular feet shapes and sizes. Computer-enabled visioning technology may make it possible to scan feet, such as to achieve an accurate three dimensional model of a foot. In one example, computer-enabled visioning technology may be used in conjunction with pressure-sensing technology to detect foot pressure points. The three dimensional and pressure sensing models may be used in combination (or separately) to determine a particular shape and size for an adjustable portion 120 of last 100.

Returning to FIG. 1, last 100 may comprise a solid upper portion 110, and adjustable portion 120 may be arranged in a lower portion of last, such as to enable customization of a portion (e.g., an arch, a heel, etc.) of footwear. Customization may be achieved in one case by using a moldable material 105, shown with crossed hash marks, arranged in adjustable portion 120. An interchangeable mold cover 125 may be used to facilitate molding of moldable material 105.

To illustrate, moldable material 105 may be inserted in a hollow receptacle of adjustable portion 120 of last 100. In one example, adjustable portion 120 may comprise an adjustable arch and/or heel portion, such as for providing last 100 with customized arch and/or heel geometries. Moldable material 105 may be malleable, flexible, and/or soft in order to be caused to take a desired form, such as a form determined based on computer-enabled visioning technology. Interchangeable mold cover 125 may have a size and shape that defines an inner surface that, when pressed against by a moldable material, yields a form corresponding to the form determined based on computer-enabled visioning scanning. Moldable material 105 may be caused to take a form corresponding to that of interchangeable mold cover 125 (which may correspond, in turn, to the desired form, as noted above), such as via the application of pressure to moldable material 105. Moldable material 105 may be subsequently solidified.

Suitable materials for moldable material 105 may comprise waxes with high melt temperatures, such as having melting points of approximately 60° C. Sample waxes can include carnuba, candelilla, and high-melt paraffin waxes. Alternatively, low melt temperature thermoplastics, such as having a melting point of approximately 60° C. may be suitable to be used as moldable material 105. An example low melt temperature thermoplastic includes CAPA 6800 polyester, by Perstorp Holding AB (and having a business address Neptunigatan 1, 211 20 Malmö, Sweden). Implementations with such materials as moldable material 105 may use application of heat to moldable material 105 to soften moldable material 105 and to facilitate molding. Moldable material 105 may be cooled to yield a solidified form.

Other sample materials that may be suitable moldable materials may include supersaturated salt solutions, such as sodium acetate trihydrate. In one case, a supersaturated salt solution may be liquid prior to nucleation, which may be activated, such as by manipulating a piece of metal in the supersaturated salt solution (e.g., by bending the piece of metal or contacting it with a plunger, etc.). Nucleation of the supersaturated salt solution may cause moldable material 105 to crystallize and solidify. Heating the solidified moldable material 105 may make it possible to again mold moldable material 105.

Other sample materials for moldable material 105 may comprise materials responsive to electromagnetic fields (EMFs). By way of illustration, ferro-fluids and ferrous ball bearings may be used as moldable material 105. Once a desired form is achieved with the ferro-fluid or ferrous ball bearings, a magnetic field may be applied to cause moldable material 105 to solidify for manufacture of footwear.

As should be apparent, therefore, use of moldable material 105 in an adjustable portion 120 of last 100 and enclosed by interchangeable mold cover 125 may enable last customization for footwear manufacture.

Figure 2:
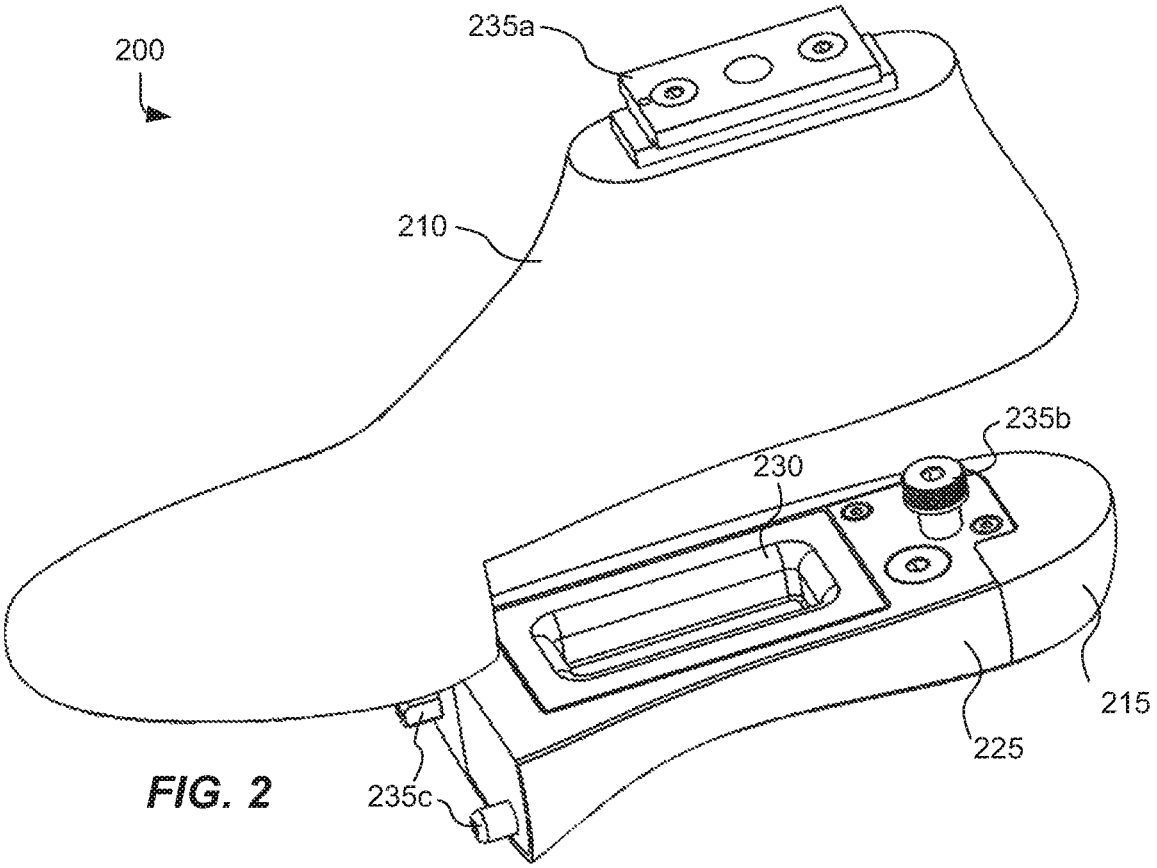
FIG. 2 is a profile view of another example customizable last.

At times, it may be desirable to solidify a moldable material within a smaller space. FIG. 2 illustrates an example last 200 that may comprise a detachable lower portion 215. For example, moldable material 205 may be received and solidified within lower portion 215, such as to form a customized arch and/or heel shape and size. Lower portion 215 may be attached and detached from upper portion 210 by engaging and disengaging, respectively, mounting hardware 235*b* and 235*c* from upper portion 210.

As such, in one example case, lower portion 215 may be detached from upper portion 210 by disengaging mounting hardware 235*b* and 235*c*. Moldable material 205 may be deposited in a hollow receptacle of lower portion 215, such as behind interchangeable mold cover 225 in FIG. 2. Pressure may be applied through backpressure cavity 230 and may cause moldable material 205 to take a shape corresponding to an interior surface of interchangeable mold cover 225 (which may thus correspond to an arch and heel shape in one example). For example, if interchangeable mold cover 225 corresponds to a desired arch and heel shape, using pressure to cause moldable material 205 to take a form corresponding to interchangeable mold cover 225, last 200 may be customized to a particular arch and heel shape and size. Lower portion 215 may be attached to upper portion 210 resulting in a last, last 200, that may be usable for fabrication of footwear. For example, mounting hardware 235*a* may be used to mount last 200 on an apparatus for footwear manufacture. Components of footwear may be mounted on last 200 for assembly, for instance, and the resulting footwear may have a form reflecting the desired arch and heel shape and size solidified in moldable material 205 within adjustable portion 220.

As noted above, solidification and softening (e.g., rendering malleable or liquefying, for example) may occur in response to application of cold and heat, respectively, in one implementation. For example, a moldable material, such as moldable material 205 in FIG. 2, may be heated to near (or above) its melting point such that the moldable material may become malleable. While malleable (or in a liquid state), the moldable material may be pressed against an interchangeable mold cover 225 to take a desired size and shape. The moldable material may be subsequently cooled to a solid state, such as by removal of a heating source and/or application of a cooling source, by way of non-limiting example.

Figure 3:
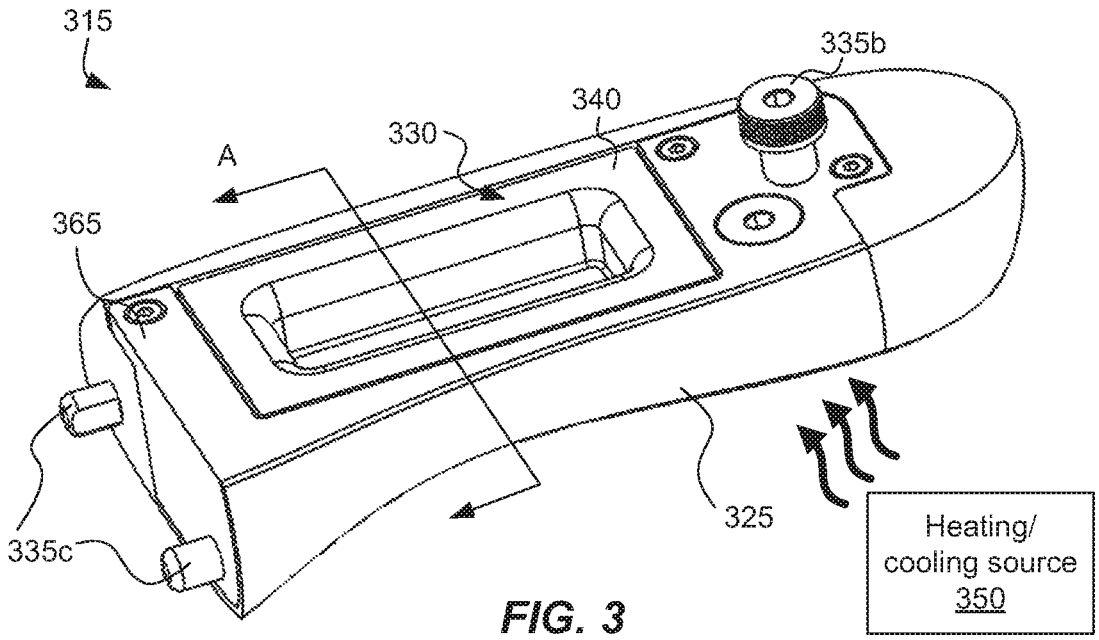
FIG. 3 is a profile view of an example lower portion of a customizable last.

Sources of heating and cooling may be arranged internally or externally to a moldable material. For example, in one case, heating and cooling conduits may be arranged within a last. In another example, it may be desirable to arrange sources of heating and cooling externally to a last, such as to reduce a mechanical complexity of the last, by way of illustration. For instance, as illustrated in FIG. 3, a heating and/or cooling source 350 may be arranged external to a lower portion 315 of a last. The heating and/or cooling source 350 may be capable of enabling solidification and softening of a moldable material enclosed behind interchangeable mold cover 325. While illustrated as an integrated element, heating and/or cooling source 350 may comprise independent heating and cooling elements, for example.

While many footwear manufacturing processes may involve exposing the last to temperatures lower than approximately 50° C., in some cases, a last may be exposed to temperatures above a melting point of a moldable material. To enable moldable material to remain solid while exposed to temperatures above a melting point of the material, an element demonstrating an ability to store thermal energy or having a good thermal mass (e.g., thermal capacitance) may be arranged within the last. Such thermal mass elements may thus allow a last containing a moldable material to be exposed to temperatures exceeding a melting point of the material. Thus, for instance, the presence of a thermal mass, such as thermal mass 365 in FIG. 3, may act to reduce temperature fluctuations and constrain a temperature of a moldable material to a band below the melting point of the moldable material, even when exposed to temperatures greater than that melting point.

Figure 4:
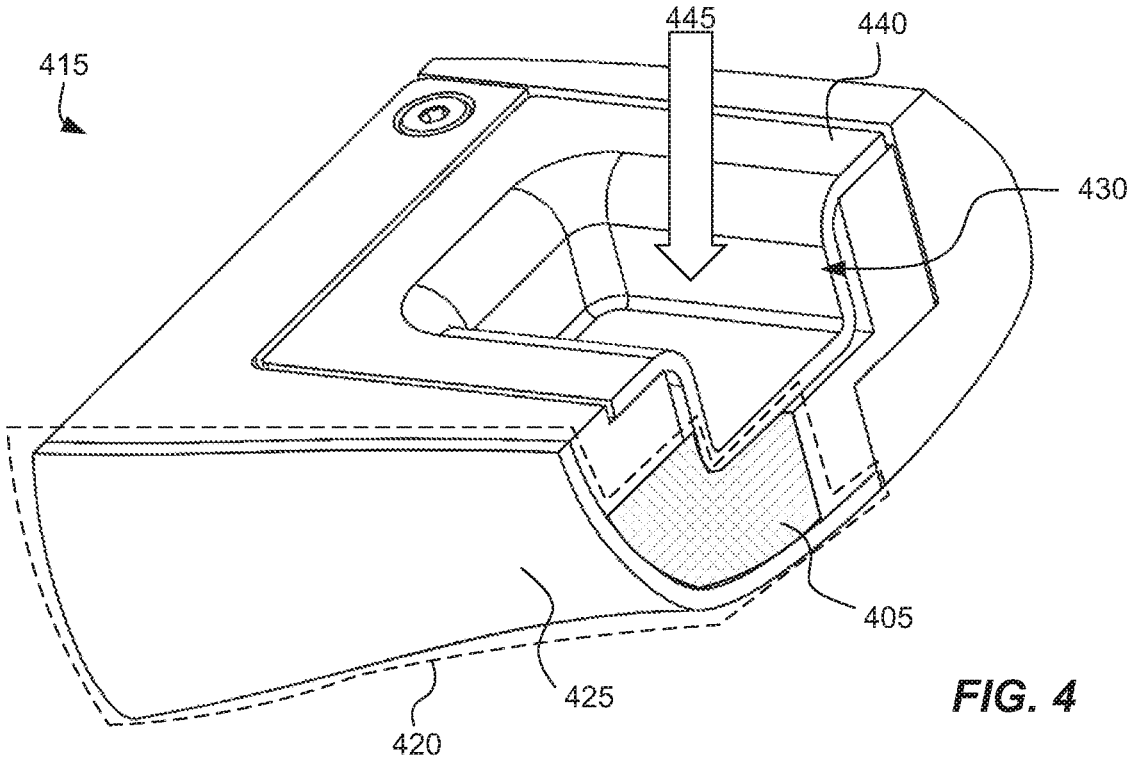
FIG. 4 is a cross section view of an example lower portion of a customizable last.

Moving on to FIG. 4, a cross section of a lower portion 415 is illustrated from the point of view illustrated by the arrows A in FIG. 3. As discussed above, pressure may be placed on a moldable material 405 via backpressure cavity 430. A backpressure cavity insert 440 may be used to distribute pressure across moldable material 405 in a relatively uniform manner. Should backpressure cavity insert 440 be too soft, pressure applied through backpressure cavity 430 may cause localized depressions. In contrast, should backpressure cavity insert 440 be too hard, pressure applied through backpressure cavity 430 may not adequately translate to moldable material 405, and thus moldable material 405 may not take a desired shape and size. In one case, an example backpressure cavity insert 440 may comprise a silicon rubber with a durometer of approximately 30-40, by way of illustration.

FIG. 4 uses an arrow 445 to illustrate a force being applied to backpressure cavity insert 440. The force may be applied using spring force, by way of example. In another case, the force illustrated by arrow 445 may be applied using gas (e.g., air) pressure. Thus, in one case, air pressure may be directed towards backpressure cavity 430. Backpressure cavity insert 440 may distribute the pressure evenly throughout its surface. The pressure may thus be transmitted to a moldable material 405, which may be pressed against an interchangeable mold cover 425, causing moldable material 405 to take a shape and size corresponding to an interior surface of moldable material 405. Moldable material 405 be subsequently solidified. The resulting shape and size may be part of an adjustable portion 420 that corresponds to a desired foot geometry (e.g., an arch and heel shape and size).

Figure 5:
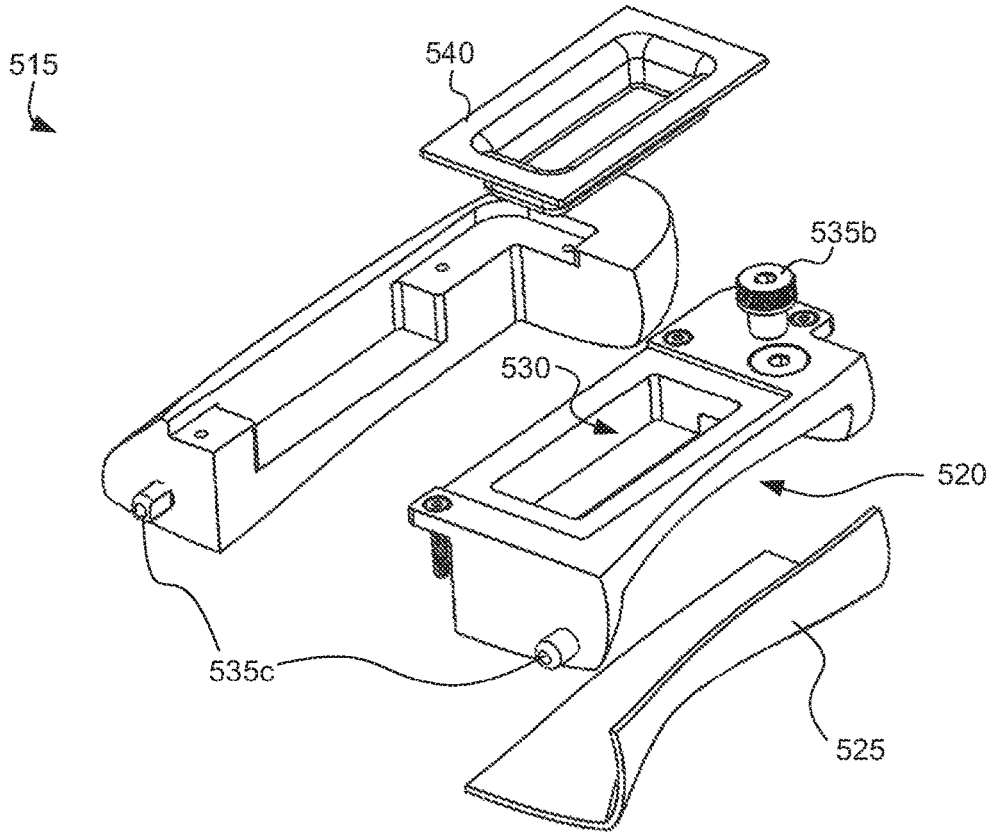
FIG. 5 is an exploded view of an example lower portion of a customizable last.

FIG. 5 is an exploded view of an example lower portion 515. As illustrated, lower portion 515 may comprise multiple solid components that may be fixably connected to define an adjustable portion 520 comprising a hollow receptacle to receive a moldable material, such as moldable material 405, discussed above. An interchangeable mold cover 525 may be attached and detached from lower portion 515 to enclose the moldable material. A backpressure cavity 530 may be arranged with respect to the hollow receptacle of the adjustable portion 520 for application of pressure on a moldable material. The back pressure may be applied to backpressure cavity insert 540. Once the moldable material is solidified, lower portion 515 may be attached to an upper portion, such as upper portion 210 in FIG. 2, via mounting hardware 535*b* and 535*c*.

Figure 9:
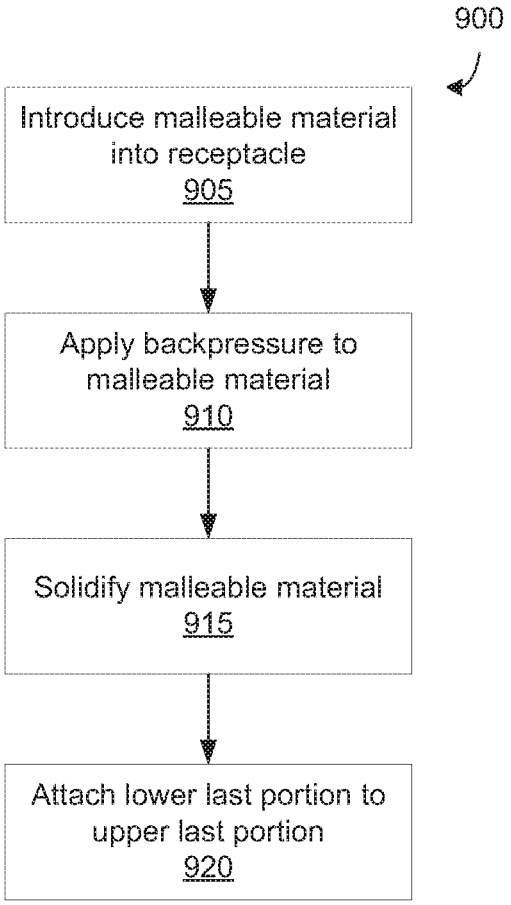
FIG. 9 is a flow chart illustrating an example method.

By way of illustration, reference is made to method 900 of FIG. 9 in conjunction with the following brief discussion of elements in FIG. 5. In one implementation, a moldable material, such as a high melt temperature wax, may be melted above its melting point to yield a softened material that may be molded to correspond to a desired shape and size. The moldable material may be inserted into a hollow receptacle of adjustable portion 520 and interchangeable mold cover 525 may be arranged on lower portion 515 to enclose the softened moldable material, such as shown by block 905 of FIG. 9. Pressure may be applied to the moldable material through backpressure cavity 530 by a pressure mechanism, such as a spring or air pressure, by way of example, such as shown by block 910 of FIG. 9. The applied pressure may cause the moldable material to take a form corresponding to that of interchangeable mold cover 525. The moldable material may be cooled to solidify (such as shown by block 915 of FIG. 9). And the lower portion 515 may be attached to an upper portion (e.g., 210, in FIG. 2) to yield a last with an adjustable portion 520 having a desired shape and size, and which may be used to manufacture footwear having a shape and size (e.g., of an arch height or heel width, by way of non-limiting example) that has been customized, such as based on computer vision scanning and/or pressure sensing systems.

Figure 6:
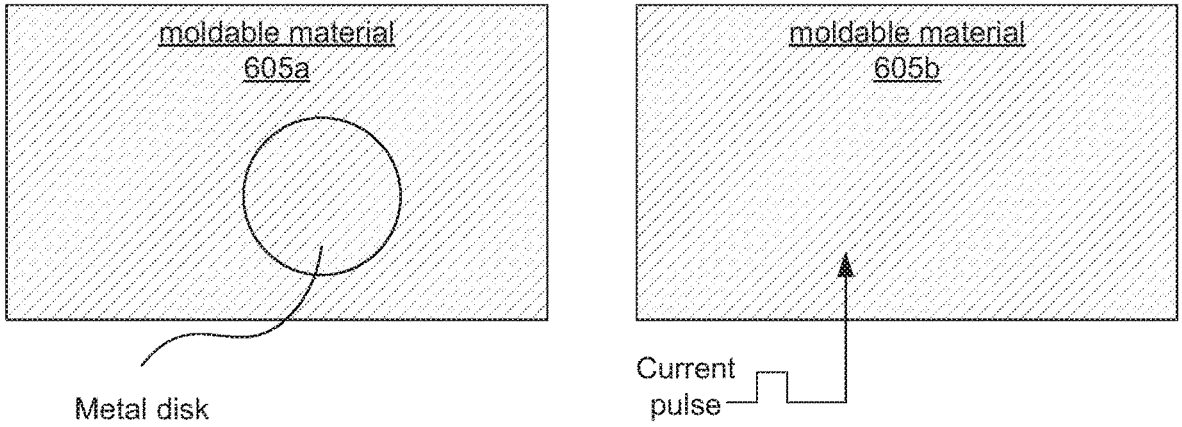
FIG. 6 includes schematic illustrations of example moldable materials.

As noted above, a number of moldable materials may be used in an adjustable portion of a last. As noted, in some example cases, high melt temperature waxes may be appropriate, such as for providing a desired form and able to withstand temperatures of footwear manufacture without melting. Additionally, low melt temperature thermoplastics may be suitable. FIG. 6 illustrates sample moldable materials 605*a* and 605*b*, which represent sample supersaturated salt solutions. Sodium acetate ($CH_3COONa$) is discussed as a possible material exhibiting desired characteristics for some footwear manufacture. For example, sodium acetate trihydrate crystals may be melted to dissolve their crystalline structure and subsequently allowed to cool to form a supersaturated aqueous solution. In its supersaturated state, the sodium acetate may be received within an adaptable portion of a last, and pressure may be applied, such as through a backpressure cavity, to cause the supersaturated sodium acetate to take a form corresponding to an interchangeable mold cover. Nucleation may be triggered in the supersaturated sodium acetate in response to an interaction with a metal element (e.g., a metallic strip or disk) within the solution. For example, moldable material 605*a* illustrates an implementation in which a metallic disk may be bent or struck, such as by a plunger mechanism, and nucleation may result, leading to crystallization of the supersaturated salt solution. In another implementation, such as shown by moldable material 605*b*, one or more current pulses or electrical charges may be transmitted to the supersaturated solution to initiate nucleation.

Figure 7:
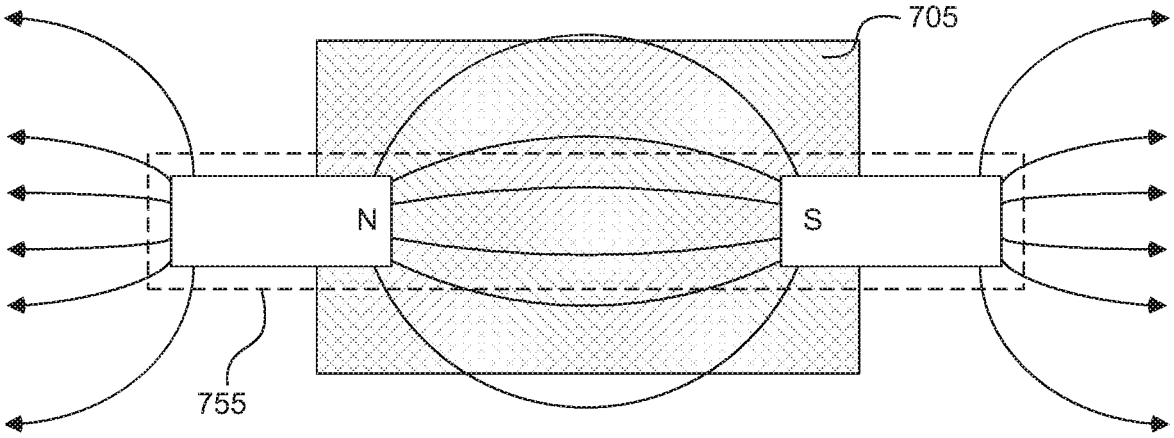
FIG. 7 is a schematic illustration of another example moldable material.

FIG. 7 illustrates yet another implementation in which instead of applying a current or manipulating a metal component, a moldable material 705 may be solidified by application of an electromagnetic field (EMF). A pair of magnets is illustrated to represent an EMF source 755. Of course, a number of suitable EMF sources would be suitable for causing a moldable material 705 to solidify in response to application of an EMF. For example, in one example case, moldable material 705 may comprise a ferro-fluid that may solidify in response to an EMF generated by EMF source 755. Thus, if the ferro-fluid moldable material 705 is arranged within a hollow receptacle of an adjustable portion, an interchangeable mold cover is arranged to enclose the moldable material 705 within the last, backpressure is applied to moldable material 705 through a backpressure cavity, and an EMF is applied to cause moldable material 705 to solidify, a resulting last may be used for footwear manufacture.

In view of the foregoing, a customizable shoe last may comprise a solid portion, an adjustable portion, and an interchangeable mold cover to enclose the adjustable portion. A moldable material that is selectively solidifiable for footwear manufacture may be arranged within the adjustable portion. The customizable shoe last may also comprise a backpressure cavity arranged with respect to the adjustable portion to enable application of pressure on the moldable portion through the backpressure cavity. The customizable shoe last may also comprise a thermal mass arranged within the last to constrain a temperature of the last below a melting point of the moldable material for shoe manufacture temperatures greater than the melting point.

Suitable materials for the moldable material may comprise high melt temperature waxes, such as carnauba wax. Other suitable materials include low melt temperature thermoplastics, supersaturated salt solutions, and metals, metalloids, and alloys responsive to EMFs.

In one example case, the customizable shoe last may comprise a detachable lower portion in which the adjustable portion may be arranged.

In another example case, a shoe last comprises a solid upper portion, and a detachable lower portion. The detachable lower portion comprises a hollow receptacle to receive a moldable material that is solidifiable for footwear manufacture. The detachable lower portion also comprises a backpressure component for imparting pressure on moldable material arranged within the hollow receptacle. The detachable lower portion also comprises an interchangeable mold cover to enclose the moldable material inside the hollow receptacle.

The backpressure component comprises a backpressure cavity arranged to be accessible from a top portion of the detachable lower portion. And the hollow receptacle is arranged on a bottom portion of the detachable lower portion. The hollow receptacle, the moldable material, and the interchangeable mold cover are arranged to enable customizable arch geometry. In one case, the moldable material is arranged within detachable lower portion such that heating and the cooling are to be applied externally to the shoe last. For example, the moldable material may comprise a melting point of approximately 60° C. or more and may be applied externally.

In yet another example, a customizable shoe last comprises a moldable material arranged within a receptacle of the customizable shoe last, an interchangeable mold cover arranged to enclose the receptacle and the moldable material, and a backpressure cavity arranged as to the moldable material to enable application of backpressure on the moldable material to mold the moldable material to correspond to a form of the interchangeable mold cover. The moldable material may solidify to retain the form of the interchangeable mold cover In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. A customizable shoe last comprising:

a solid upper portion for shaping an upper portion of a shoe and an adjustable portion, the adjustable portion comprising a moldable material that has an adjustable shape while attached to a portion of the solid upper portion of the shoe last and that is selectively solidifiable for footwear manufacture;

an interchangeable mold cover to enclose the adjustable portion; and a pressure cavity to put an outward pressure on the moldable material to cause the moldable material to press against the interchangeable mold cover.

2. The customizable shoe last of claim 1, wherein the outward pressure put on the moldable material by the pressure cavity is further to deform the moldable material into a shape defined by the mold cover.

3. The customizable shoe last of claim 1, wherein the adjustable portion of the shoe last is arranged in a detachable lower portion of the shoe last.

4. The customizable shoe last of claim 1, further comprising a thermal element having a thermal mass to store thermal energy, wherein the thermal element is located in the last adjacent to the moldable material, and wherein the thermal element is configured to constrain a temperature of the moldable material to below a melting point of the moldable material when the last is exposed to shoe manufacture temperatures greater than the melting point of the moldable material.

5. The customizable shoe last of claim 1, wherein the moldable material comprises a high melt temperature wax or a low melt temperature thermoplastic.

6. The customizable shoe last of claim 1, wherein the moldable material comprises a supersaturated salt solution.

7. The customizable shoe last of claim 6, wherein the supersaturated salt solution is solidifiable responsive to manipulation of a metal element within the supersaturated salt solution or application of an electrical charge to the supersaturated salt solution.

8. The customizable shoe last of claim 1, wherein the moldable material comprises metals, metalloids, or alloys solidifiable responsive to application of a magnetic field.

9. The customizable shoe last of claim 1, further comprising a plurality of different interchangeable mold covers of different shapes that are attachable to the solid upper portion.

10. The customizable shoe last of claim 1, wherein the solid upper portion further comprises mounting hardware to mount the customizable shoe last on an apparatus for footwear manufacture.

11. The customizable shoe last of claim 1, wherein the solid upper portion comprises a toe portion of the shoe last and the adjustable portion comprises an arch portion and a heel portion of the shoe last.

12. A customizable shoe last comprising:

a solid portion and an adjustable portion, the adjustable portion comprising a moldable material that has an adjustable shape while attached to a portion of the solid portion of the shoe last and that is selectively solidifiable for footwear manufacture; and an interchangeable mold cover to enclose the adjustable portion, wherein:

the solid portion is a solid upper portion; and the adjustable portion is a detachable lower portion comprising a hollow receptacle to receive the moldable material that is solidifiable for footwear manufacture, and a backpressure component for imparting pressure on the moldable material arranged within the hollow receptacle; and the interchangeable mold cover is to enclose the moldable material inside the hollow receptacle.

13. The shoe last of claim 12, wherein the backpressure component comprises a backpressure cavity arranged to be accessible from a top portion of the detachable lower portion and further wherein the hollow receptacle is arranged on a bottom portion of the detachable lower portion.

14. The shoe last of claim 12, wherein the hollow receptacle, the moldable material, and the interchangeable mold cover are arranged to enable customizable arch geometry, wherein arch geometry comprises shapes and sizes of arch and heel portions of the shoe last.

15. The shoe last of claim 12, wherein the moldable material is arranged within the detachable lower portion such that heating and cooling are to be applied externally to the shoe last.

16. The shoe last of claim 12, wherein:

the moldable material comprises a melting point of approximately 60° C. or more.

17. A customizable shoe last having a foot shape and size, the foot shape comprising an arch portion, a heel portion, a toe portion and an upper portion, the shoe last comprising:

a moldable material arranged within a receptacle of the customizable shoe last, the receptacle and moldable material being contained inside the foot shape;

an interchangeable mold cover shaped to correspond to an exterior foot surface of the foot shape and arranged to enclose the receptacle and the moldable material inside the foot shape, the mold cover having a size and shape that correspond to and define a desired shape into which the moldable material will be conformed when the shoe last is customized; and a backpressure cavity arranged to enable application of backpressure on the moldable material in an outward direction with respect to the foot shape to force the moldable material into and against the mold cover to mold the moldable material to correspond to the desired shape defined by the interchangeable mold cover;

wherein the moldable material solidifies to retain the form of the interchangeable mold cover.

18. The shoe last of claim 17, wherein the backpressure cavity comprises a backpressure cavity insert.

19. The shoe last of claim 17, wherein the backpressure cavity contains a gas with a pressure to press the moldable material outwardly against the mold cover.

* * * * *